US010163339B2

(12) United States Patent
Liu et al.

(10) Patent No.: US 10,163,339 B2
(45) Date of Patent: Dec. 25, 2018

(54) MONITORING TRAFFIC CONGESTION

(71) Applicant: SAP SE, Walldorf (DE)

(72) Inventors: Jing Liu, Nanjing (CN); Qiwei Zhang, Shanghai (CN); Jun Liu, Nanjing (CN); Yinling Ni, Shanghai (CN)

(73) Assignee: SAP SE, Walldorf (DE)

( * ) Notice: Subject to any disclaimer, the term of this patent is extended or adjusted under 35 U.S.C. 154(b) by 134 days.

(21) Appl. No.: 15/378,036

(22) Filed: Dec. 13, 2016

(65) Prior Publication Data

US 2018/0165952 A1 Jun. 14, 2018

(51) Int. Cl.

| | |
|---|---|
| ***G08G 1/065*** | (2006.01) |
| ***G08G 1/01*** | (2006.01) |
| ***G08G 1/052*** | (2006.01) |

(52) U.S. Cl.
CPC ..... *G08G 1/0133* (2013.01); *G08G 1/0112* (2013.01); *G08G 1/052* (2013.01)

(58) Field of Classification Search
CPC ..... G08G 1/0133; G08G 1/0112; G08G 1/052
See application file for complete search history.

(56) References Cited

U.S. PATENT DOCUMENTS

| | | | | |
|---|---|---|---|---|
| 7,587,186 | B2 * | 9/2009 | Duckeck | H04L 9/00 235/382 |
| 8,065,073 | B2 | 11/2011 | Barker et al. | |
| 9,135,826 | B2 | 9/2015 | Malhotra | |
| 9,142,125 | B1 | 9/2015 | Lu | |
| 9,489,838 | B2 | 11/2016 | Fowe et al. | |
| 2007/0208495 | A1 * | 9/2007 | Chapman | G08G 1/0104 701/117 |
| 2008/0071465 | A1 * | 3/2008 | Chapman | G01C 21/3691 701/117 |
| 2012/0065871 | A1 * | 3/2012 | Deshpande | G08G 1/0112 701/118 |
| 2012/0072096 | A1 * | 3/2012 | Chapman | G08G 1/0133 701/118 |
| 2012/0316765 | A1 * | 12/2012 | Marko | G08G 1/0112 701/119 |
| 2013/0268174 | A1 * | 10/2013 | Koshizen | B60W 30/16 701/96 |

(Continued)

FOREIGN PATENT DOCUMENTS

| | | | |
|---|---|---|---|
| CN | 102945604 | A | 2/2013 |
| CN | 103942953 | A | 7/2014 |

(Continued)

OTHER PUBLICATIONS

Schonhof et al., Empirical Features of COngested Traffic States and Their Implications for Traffic Modeling, Feb. 2008, pp. 1-39.*

*Primary Examiner* — Quang Pham
(74) *Attorney, Agent, or Firm* — Jones Day

(57) ABSTRACT

Described herein is a framework to monitor traffic congestion. In accordance with one aspect of the framework, the framework receives vehicle data from vehicle data sources located in a region of interest. The framework may determine a sample size and an average speed for an edge of the region of interest based on the vehicle data. Congestion probability may then be determined based on the sample size and average speed. A report may be presented based on the congestion probability.

20 Claims, 10 Drawing Sheets

200

(56) References Cited

U.S. PATENT DOCUMENTS

| | | | | |
|---|---|---|---|---|
| 2015/0262477 | A1* | 9/2015 | Fowe | G08G 1/0133 701/118 |
| 2015/0379871 | A1* | 12/2015 | Koshizen | B60W 40/04 701/118 |
| 2016/0202074 | A1* | 7/2016 | Woodard | G06Q 10/047 701/465 |
| 2017/0146360 | A1* | 5/2017 | Averbuch | G01C 21/3679 |
| 2017/0180949 | A1* | 6/2017 | Nishimura | H04W 4/02 |

FOREIGN PATENT DOCUMENTS

| | | | |
|---|---|---|---|
| CN | 104637313 | A | 5/2015 |
| CN | 105160874 | A | 12/2015 |

* cited by examiner 304 306 308 310

| | EDGE_ID | TIMESTAMP | SPEED | VEHICLE_COUNT |
|---|---|---|---|---|
| 1 | 4,269,319,865,237,760 | Jul 17, 2016 4:00:00.0 PM | 72.9000015258789 | 107 |
| 2 | 4,269,319,798,128,896 | Jul 17, 2016 4:00:00.0 PM | 59.79999923706055 | 106 |
| 3 | 4,269,319,848,460,544 | Jul 17, 2016 4:00:00.0 PM | 58.20000076293945 | 102 |
| 4 | 4,269,319,865,239,553 | Jul 17, 2016 4:00:00.0 PM | 73.80000305175781 | 97 |
| 5 | 4,269,278,744,282,368 | Jul 17, 2016 4:00:00.0 PM | 51.5 | 86 |
| 6 | 4,269,278,727,504,384 | Jul 17, 2016 4:00:00.0 PM | 50.70000076293945 | 84 |
| 7 | 4,269,319,865,242,880 | Jul 17, 2016 4:00:00.0 PM | 71.30000305175781 | 80 |
| 8 | 2,679,240,931,673,344 | Jul 17, 2016 4:00:00.0 PM | 21.299999237060... | 79 |
| 9 | 1,502,607,109,523,713 | Jul 17, 2016 4:00:00.0 PM | 28.800000381469... | 74 |
| 10 | 1,252,559,415,150,848 | Jul 17, 2016 4:00:00.0 PM | 22.899999618530... | 73 |

302

*Fig. 3*

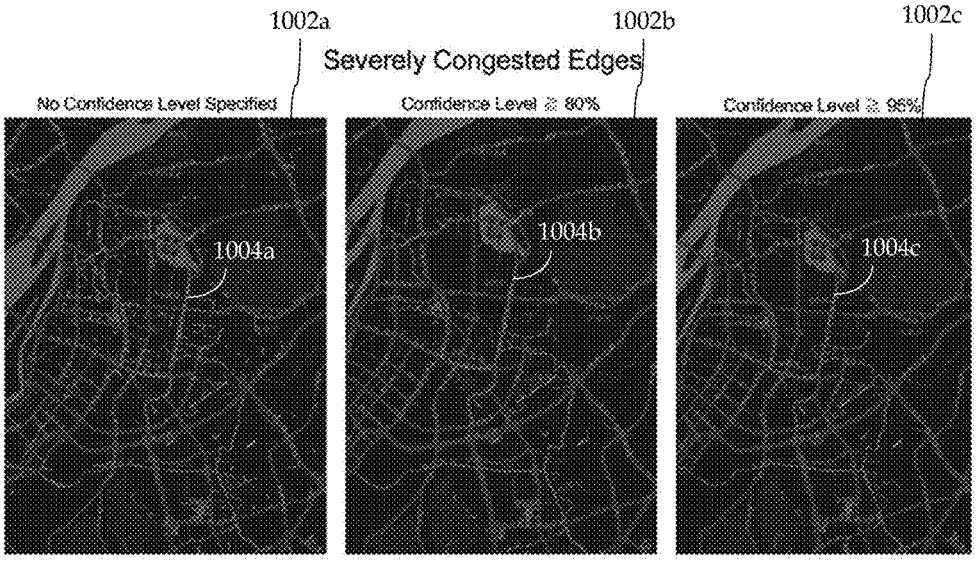
*Fig. 10a* *Fig. 10b* *Fig. 10c*

MONITORING TRAFFIC CONGESTION

TECHNICAL FIELD

The present disclosure relates generally to computer systems, and more specifically, to a framework for monitoring traffic congestion.

BACKGROUND

Traffic congestion is a common problem for big cities all over the world. To manage traffic congestion, many big cities have built information technology (IT) systems to interpret traffic situations based on average travel speed for each road section. Average travel speed is an intuitive way to illustrate the reduction of mobility experienced during congestion, and is widely used in interpreting meso-level and macro-level traffic congestion.

Different traffic sensor data may be used in speed calculation. One type of data is the floating car data (FCD), which typically includes global positioning system (GPS) data from onboard devices in taxicabs. FCD is widely used because such data collection is effective and economical, and can be easily integrated with a geographical information system and summarized at any level.

Taxicabs are typically not equally distributed in a road network, which means there are different sample sizes for calculating average travel speed for different road sections. For extreme cases, a recognized traffic congestion point may be totally wrong as there may be only a single abnormal taxicab available for speed calculation in a certain road section. If random errors are not taken into account in speed calculation, a stable and reliable outcome cannot be determined.

SUMMARY

A framework for monitoring traffic congestion is described herein. In accordance with one aspect of the framework, the framework receives vehicle data from vehicle data sources located in a region of interest. The framework may determine a sample size and an average speed for an edge of the region of interest based on the vehicle data. Congestion probability may then be determined based on the sample size and average speed. A report may be presented based on the congestion probability.

With these and other advantages and features that will become hereinafter apparent, further information may be obtained by reference to the following detailed description and appended claims, and to the figures attached hereto.

BRIEF DESCRIPTION OF THE DRAWINGS

Some embodiments are illustrated in the accompanying figures, in which like reference numerals designate like parts, and wherein:

FIG. 3 shows an exemplary table that stores the results returned by congestion monitor;

FIG. 10*a* shows a map that displays severely congested roads without specifying the level of confidence;

FIG. 10*b* shows a map that displays severely congested roads with confidence level 80%; and FIG. 10*c* shows a map that displays severely congested roads with confidence level 95%.

DETAILED DESCRIPTION

In the following description, for purposes of explanation, specific numbers, materials and configurations are set forth in order to provide a thorough understanding of the present frameworks and methods and in order to meet statutory written description, enablement, and best-mode requirements. However, it will be apparent to one skilled in the art that the present frameworks and methods may be practiced without the specific exemplary details. In other instances, well-known features are omitted or simplified to clarify the description of the exemplary implementations of the present framework and methods, and to thereby better explain the present framework and methods. Furthermore, for ease of understanding, certain method steps are delineated as separate steps; however, these separately delineated steps should not be construed as necessarily order dependent in their performance.

Questions surrounding the issue of the number of vehicles (e.g., taxis) needed for edge-wise speed calculation based on FCD may include: "How many vehicle data samples are enough for speed calculation?" or "How many vehicle data samples are necessary for the speed calculation to be believable?". While such questions are quite subjective (i.e., based on personal judgments on "enough" or "trustable"), they can be addressed from the following two perspectives: (1) Accuracy: "How does the average edge speed calculation deviate from the true speed?"; and (2) Precision: "How does the random fluctuation affect the average edge speed calculation?". Since it is not possible to define what a "true speed" is purely by data, accuracy cannot be improved by increasing the number of vehicle data samples.

A framework for monitoring traffic congestion is described herein. One aspect of the present framework addresses the precision issue by quantifying the correlation between vehicle sample size and random error, and enhancing speed calculation and traffic congestion interpretation by considering speed deviation from random error due to limited number of data points (i.e., data samples). Random errors from sample size is a big component of systematical errors that result in deviation for average speed calculation. Such random errors may be quantified, measured and considered when interpreting traffic situations. The present framework quantifies correlation between random error and sample size, which advantageously enhances the accuracy and reliability of speed calculation and traffic situation interpretation, thereby providing a better view of traffic congestion and a more accurate identification of critically congested roads.

It should be appreciated that the framework described herein may be implemented as a method, a computercontrolled apparatus, a computer process, a computing system, or as an article of manufacture such as a computer-usable medium. These and various other features and advantages will be apparent from the following description.

Figure 1:
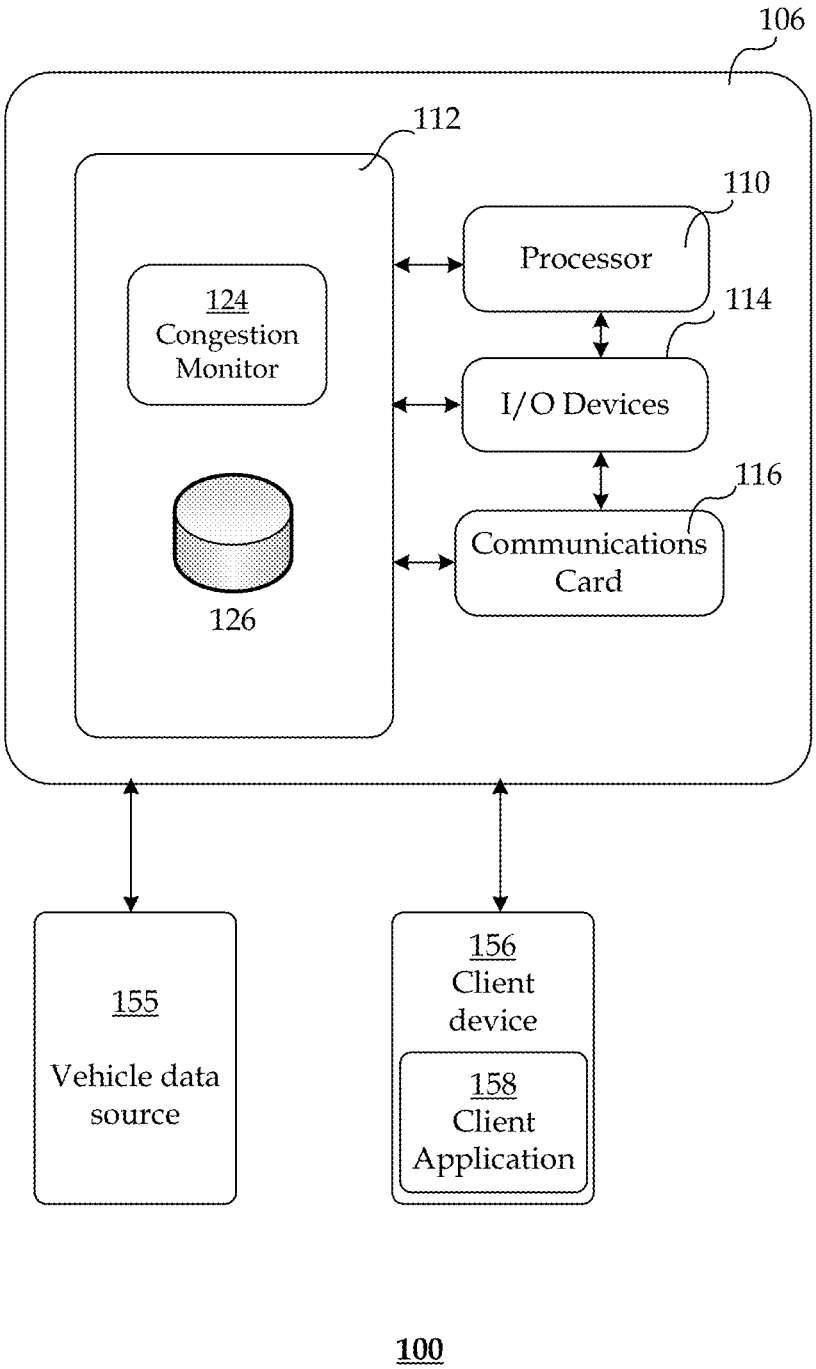
FIG. 1 is a block diagram illustrating an exemplary architecture.

FIG. 1 is a block diagram illustrating an exemplary architecture 100 in accordance with one aspect of the present framework. Generally, exemplary architecture 100 may include a computer system 106, one or more vehicle data sources 155 and one or more client devices 156.

Computer system 106 is capable of responding to and executing machine-readable instructions in a defined manner. Computer system 106 may include a processor 110, input/output (I/O) devices 114 (e.g., touch screen, keypad, touch pad, display screen, speaker, etc.), a memory module 112, and a communications card or device 116 (e.g., modem and/or network adapter) for exchanging data with a network (e.g., local area network or LAN, wide area network (WAN), Internet, etc.). It should be appreciated that the different components and sub-components of the computer system 106 may be located or executed on different machines or systems. For example, a component may be executed on many computer systems connected via the network at the same time (i.e., cloud computing).

Memory module 112 may be any form of non-transitory computer-readable media, including, but not limited to, dynamic random access memory (DRAM), static random access memory (SRAM), Erasable Programmable Read-Only Memory (EPROM), Electrically Erasable Programmable Read-Only Memory (EEPROM), flash memory devices, magnetic disks, internal hard disks, removable disks or cards, magneto-optical disks, Compact Disc Read-Only Memory (CD-ROM), any other volatile or non-volatile memory, or a combination thereof. Memory module 112 serves to store machine-executable instructions, data, and various software components for implementing the techniques described herein, all of which may be processed by processor 110. As such, computer system 106 is a general-purpose computer system that becomes a specific-purpose computer system when executing the machine-executable instructions. Alternatively, the various techniques described herein may be implemented as part of a software product. Each computer program may be implemented in a high-level procedural or object-oriented programming language (e.g., C, C++, Java, JavaScript, Advanced Business Application Programming (ABAP™) from SAP® AG Structured Query Language (SQL), etc.), or in assembly of machine language if desired. The language may be a compiled or interpreted language. The machine-executable instructions are not intended to be limited to any particular programming language and implementation thereof. It will be appreciated that a variety of programming languages and coding thereof may be used to implement the teachings of the disclosure contained herein.

In some implementations, memory module 112 includes congestion monitor 124 and database 126 for monitoring traffic congestion. Database 126 may store, for example, vehicle data provided by one or more vehicle data sources 155.

Computer system 106 may operate in a networked environment using logical connections to one or more vehicle data sources 155 and one or more client devices 156. Computer system 106 may serve to collect, process and store vehicle data from one or more vehicle data sources 155 to generate vehicle-related information. Vehicle data sources 155 include devices onboard vehicles (e.g., taxis, cars, buses) that are capable of continuously streaming vehicle data to computer system 106. In some implementations, vehicle data sources 155 include mobile devices (e.g., mobile phones) that are capable of transmitting cellular network data (e.g., code division multiple access (CDMA), global system for mobile communication (GSM), universal mobile telecommunication system (UMTS), and general packet radio service (GPRS)). Computer system 106 may distribute congestion-related information to one or more client devices 156. Such client devices 156 may include client applications 158 configured to present a user interface (e.g., a graphical user interface) to access the congestion-related information and services, including services provided by computer system 106.

Figure 2:
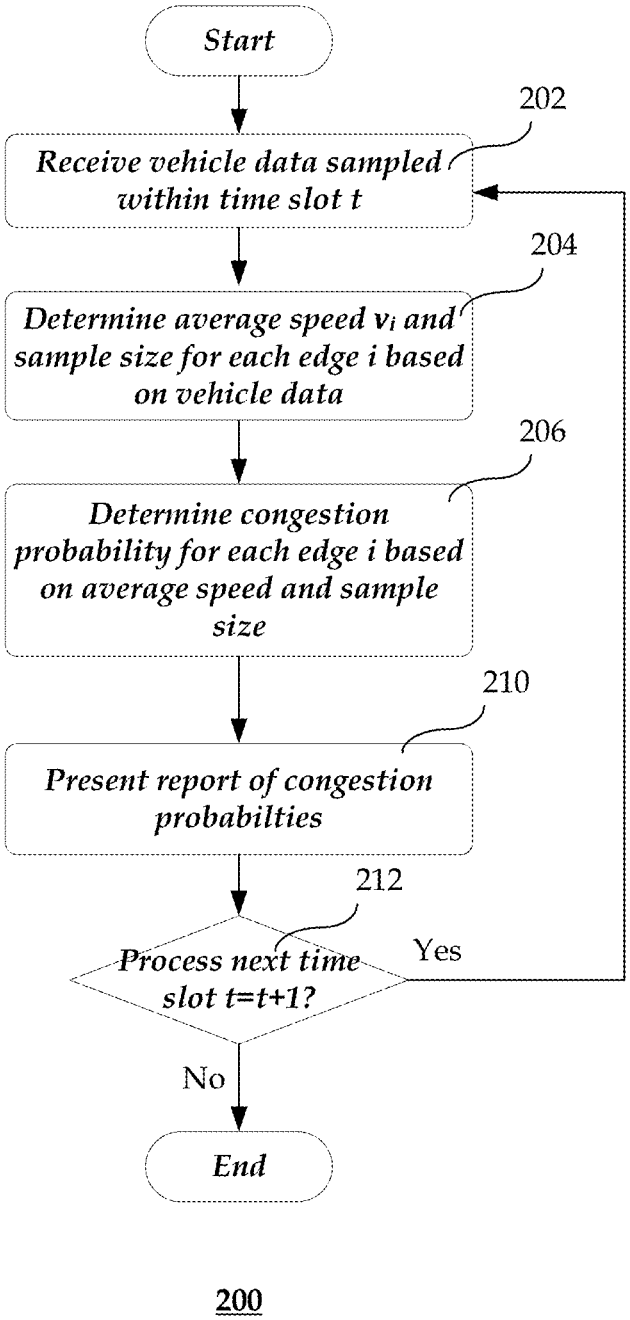
FIG. 2 shows an exemplary method for monitoring traffic congestion.

FIG. 2 shows an exemplary method 200 for monitoring traffic congestion. The method 200 may be performed automatically or semi-automatically by the system 100, as previously described with reference to FIG. 1. It should be noted that in the following discussion, reference will be made, using like numerals, to the features described in FIG. 1.

At 202, congestion monitor 124 receives vehicle data sampled within time slot t by one or more vehicle data sources 155 located in a region of interest. The region of interest may be a neighborhood, town, city or any other area with a network of edges or road segments for traveling vehicles (e.g., taxis). Each vehicle data source 155 is located in a vehicle, and may sample one or more data records during time slot t. For example, within time slot t, a vehicle data source 155 may sample and send a sequence of data records GPS1, GPS2, GPS3 to congestion monitor 124. Such sequential data records may then be used to determine the velocity of the vehicle associated with the vehicle data source 155 within this time slot t. Each record of the vehicle data may include a device identifier, localization data (e.g., GPS location data), speed and time information. Other types of information may also be stored in each vehicle data record. Vehicle data sources 155 may sample vehicle data at frequent time points (e.g., every 5 seconds). Congestion monitor 124 may then collect the vehicle data at the end of regularly-spaced time slots t (e.g., every 5 minutes, hourly or daily). The data collection may be performed in response to a request sent by computer system 106 to the one or more vehicle data sources 155.

At 204, congestion monitor 124 determines the sample size and average vehicle speed $v_i$ for each edge i based on the vehicle data. An edge i is a predefined segment of the road network of the region of interest, and may be associated with a unique identifier (EDGE_ID). Congestion monitor 124 determines the average speed $v_i$ by dividing the sum of speeds of vehicles by the sample size (i.e., number of vehicles or VEHICLE_COUNT) along edge i.

FIG. 3 shows an exemplary table 302 that stores the results returned by congestion monitor 124. Each row in table 302 stores an edge identifier 304, a time stamp 306, the average speed 308 and the vehicle count 310. The vehicle count 310 is the number of vehicles traveling along a given edge at a particular time slot, and may be referred to as the "sample size". Quantitative analysis of precision in relation to sample size (i.e., VEHICLE_COUNT) is based on the variances (in the statistical sense) of the average speed.

Returning to FIG. 2, at 206, congestion monitor 124 determines the congestion probability for each edge i based on the sample size and average speed. Congestion probability provides a measure of confidence for the estimated road congestion on a given edge i. Congestion probability may be derived based on the average speed and sample size associated with edge i. The relationship between congestion probability, average speed and sample size may be derived based on the following observations: (1) The inverse of the variance of average speed is linearly related to the sample size; and (2) The linearity (or slope) is established in a certain range of sample sizes, and the linearity and range may be different for different areas.

The easiest way for estimating variance of average speed is to directly return variance at the same time when the average speed is calculated for each edge i. However, this may not be a practical option as it is too computationally intensive. Instead, variance may be estimated from an edge-wise speed time series. More particularly, the variance for average speed may be estimated by the time series residuals between data and a state-space time series model.

Figure 4:
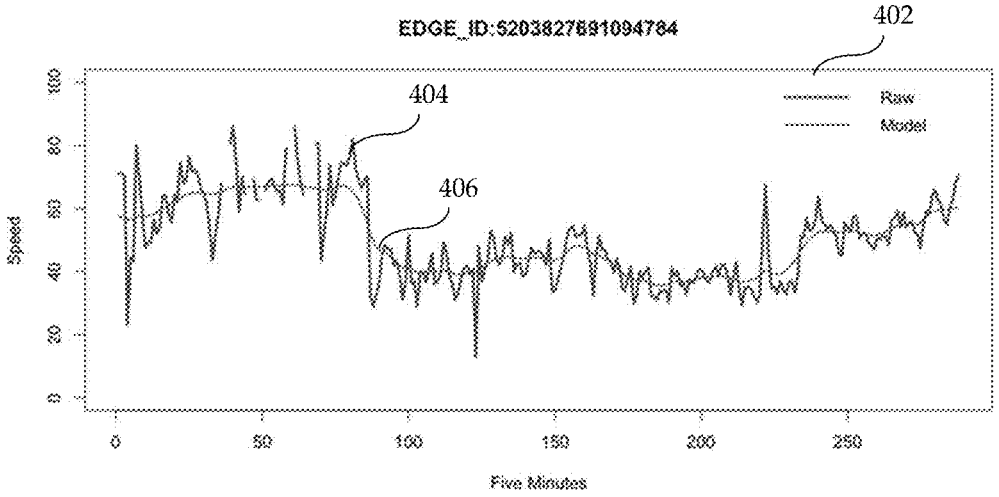
FIG. 4 shows an exemplary speed-time series and its corresponding "smoothed" state-space model for a given edge.
Figure 5A:
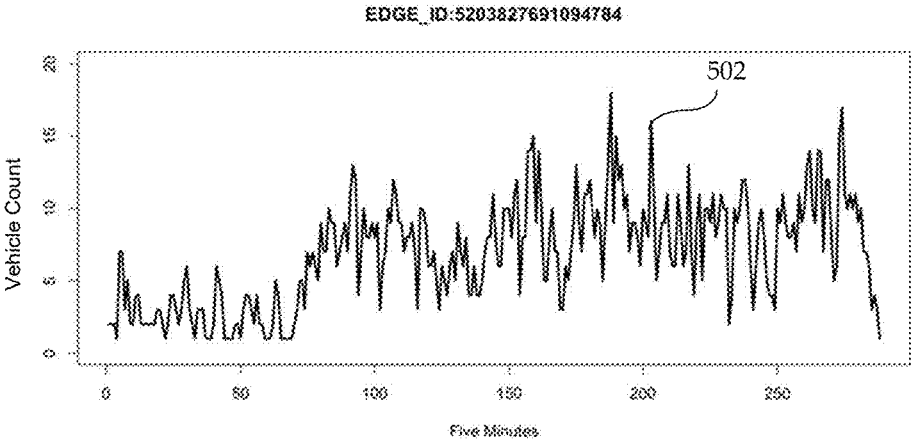
FIG. 5*a* shows the corresponding vehicle count graph.
Figure 5B:
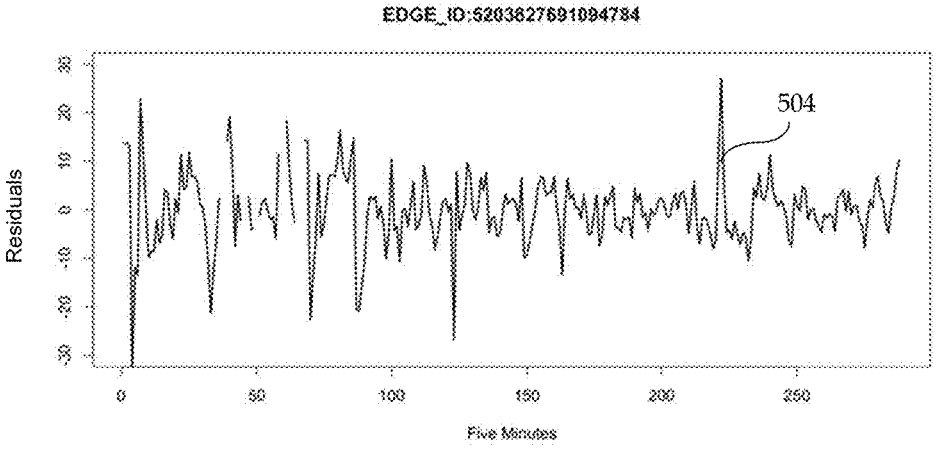
FIG. 5*b* shows the corresponding residual graph.

FIG. 4 shows an exemplary speed-time series 404 and its corresponding "smoothed" state-space model 406 for a given edge. FIG. 5*a* shows the corresponding vehicle count graph, while FIG. 5*b* shows the corresponding residual graph. The variance $\sigma^2$ of the average speed is inversely proportional to the number of samples, as expressed in the following equation:

$$\sigma^2 \propto \frac{\sigma_1^2}{N} \tag{1}$$

where $\sigma_1{}^2$ is the vehicle speed variance and N is the number of samples (i.e., vehicle count or sample size). Equivalently, the inverse of the variance $\sigma^2$ of average speed is linearly related with the sample size N.

Figure 6:
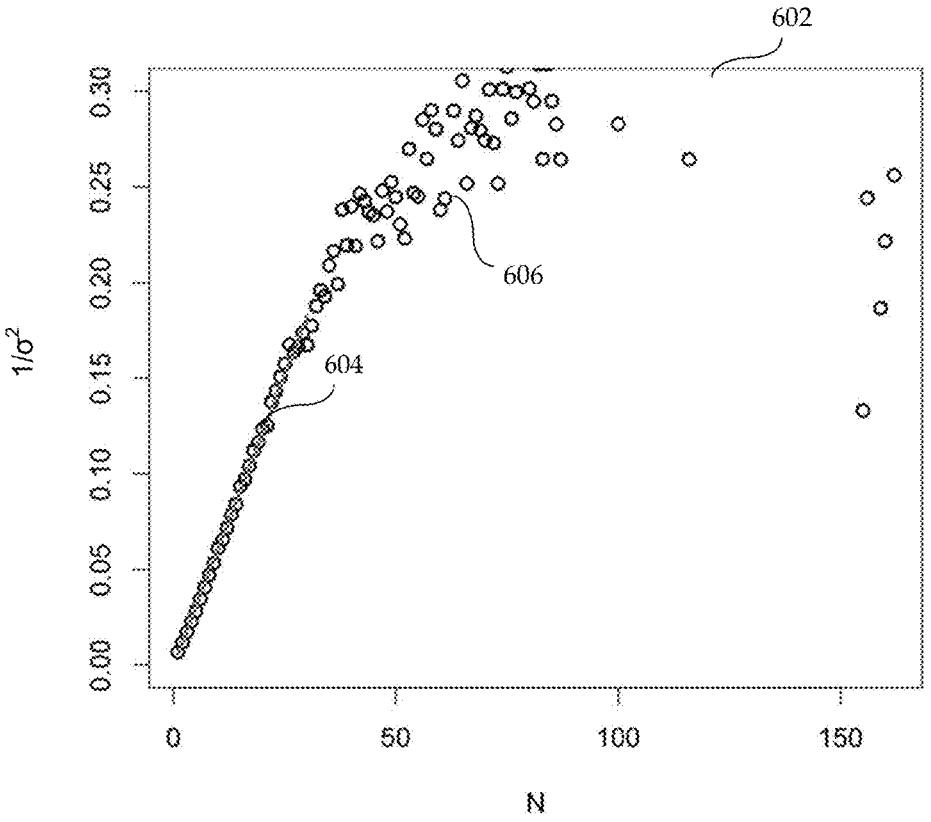
FIG. 6 is a scatter plot that illustrates the relationship between inverse variance and sample size.

FIG. 6 is a scatter plot 602 that illustrates the relationship between inverse variance ($1/\sigma^2$) and sample size N. Graph 602 includes dots representing the calculated residuals for all edges throughout the day. The line 604 is a fitted line for sample size N less than 30. As can be observed, for vehicle count N less than 30, the functional form of variance (or standard error) may be represented by a straight line 604, which follows closely to the theoretical prediction. Specially, for N≤30, $$\sigma^2 = \frac{164.37}{N} \tag{2}$$

$$\sigma = \frac{12.82}{\sqrt{N}} \tag{3}$$

wherein the value "164.37" is the inverse of the slope (or gradient) of the line 604.

As the calculation of average speed is subject to various steps of pre-processing, the nonlinearity of the variance-sample size relationship 606 for vehicle counts exceeding 30 may be attributed to many reasons. However, as a first-order approximation, the variance-sample size relationship expressed by equation (2) can still be used.

From the above analysis, the answer to the question of "how many vehicle samples are enough for speed calculation" is dependent on "how much random error of the speed calculation you can tolerate". For example, if we require (with 95% confidence) that the "true" speed is within 5 km/h error to the "calculated" speed, at least $$\left(\frac{12.8 \times 1.96}{5}\right)^2 = 25$$

vehicles are needed. This is based on the assumption of normal distribution of residual errors, where the number 1.96 is the approximate value of the 97.5 percentile point of the standard normal distribution. 95% of the area under a normal curve lies within roughly 1.96 standard deviations ($\sigma$) of the mean, and due to the central limit theorem, this number 1.96 is used in the construction of approximate 95% confidence intervals. The "true" speed only has 5% chance of falling outside the "measured" speed (+/− 1.96 $\sigma$). For 10 vehicles, the random error can be as high as 8 km/h.

Figure 7A:
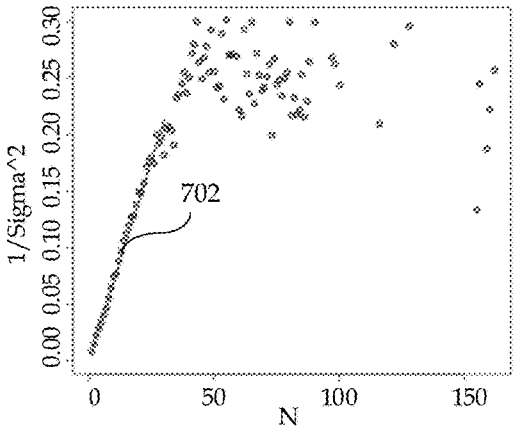
FIGS. 7*a*-7*e* show scatter plots derived from vehicle data acquired by a similar vehicle data source at 5 different areas
Figure 7B:
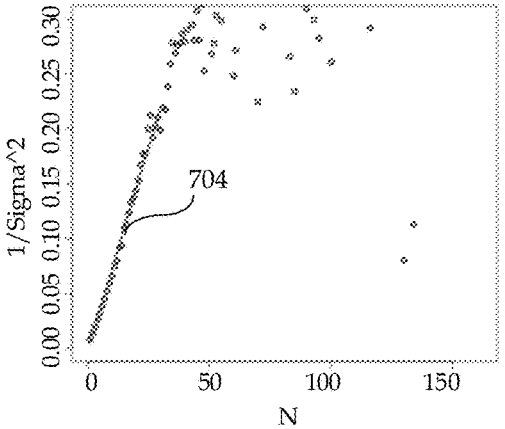
Figure 7C:
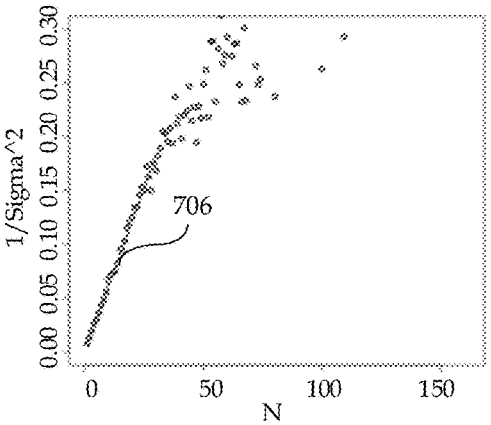
Figure 7D:
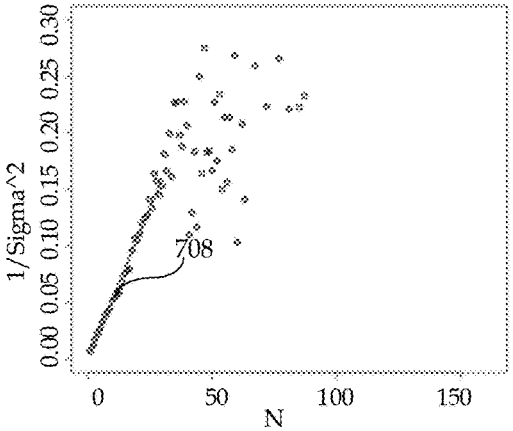
Figure 7E:
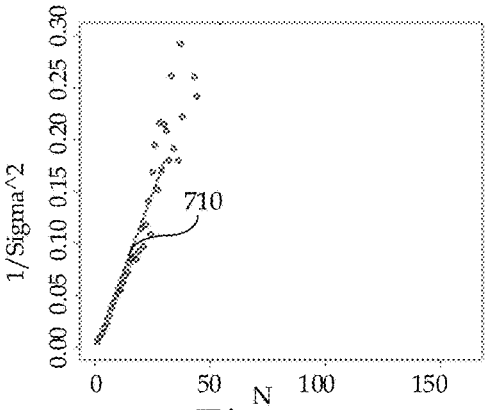

Other geographical areas were studied to further prove that "the inverse of the variance of average speed is linearly related to the sample size" is a general pattern. FIGS. 7*a* through 7*e* show scatter plots derived from vehicle data acquired by a similar vehicle data source at 5 different areas. For these 5 areas, linear fitting results are obtained. FIG. 7*a* shows a scatter plot 702 for the Qihuai area, where $\sigma=11.90/\sqrt{N}$. FIG. 7*b* shows a scatter plot 704 for the Gulou area, where $\sigma=11.72/\sqrt{N}$. FIG. 7*c* shows a scatter plot 706 for the Xuanwu area, where $\sigma=11.90/\sqrt{N}$. FIG. 7*d* shows a scatter plot 708 for the Jianye area, where $\sigma=11.72/\sqrt{N}$. FIG. 7*e* shows a scatter plot 710 for the Qixia area, where $\sigma=12.96/\sqrt{N}$.

Figure 8:
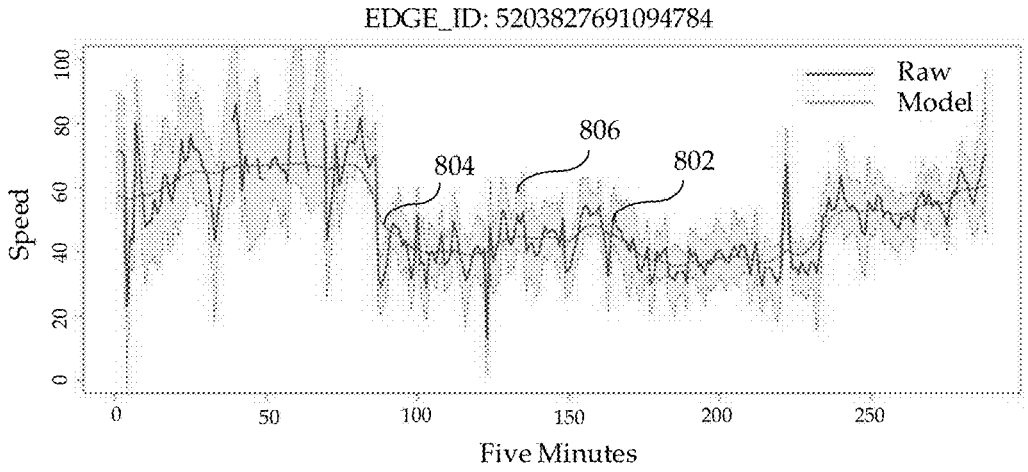
FIG. 8 shows an edge-speed model with confidence band.

FIG. 8 shows an edge-speed model 804 with confidence band 806. More particularly, a speed time series 802 and an edge-speed model 804 are shown. The confidence band 806 may be directly inferred from the vehicle count. The edge-speed model 804 with confidence band 806 may be used to identify random fluctuation of speed caused by sample size difference.

Given the number of vehicle samples $N_i$ and the "calculated" speed $v_i$, for edge i at any calculation time slot t, the distribution of "true" speed $m_i$ may be modeled by a normal probability model N as follows:

$$m_i \sim N\left(v_i, \frac{12.8}{\sqrt{N_i}}\right) \tag{4}$$

wherein the mean of the normal distribution N is $v_i$, and standard deviation of the normal distribution N is $$\frac{12.8}{\sqrt{N_i}}$$

(see Equation (3)). The value "12.8" is the square root of "164.37", which is the inverse of the slope (or gradient) of the line 604 (see Equations 2 and 3). In some implementations, the value "12.8" is predetermined based on historical vehicle data. This value may vary slightly for different regions. For example, in FIGS. 7*a* through 7*e*, the slopes of the scatter plots (702 to 710) are very close. The value "12.8" may also be estimated online based on current vehicle data of the region of interest, and be adapted to different regions of interest.

Congestion probability may be derived by the cumulative distribution of the normal probability model N, as follows:

$$Pr(m_i \le C) = \frac{1}{2}\left[1 + \mathrm{erf}\left(\sqrt{\frac{N_i}{2}}\,\frac{C - v_i}{12.8}\right)\right] \tag{5}$$

wherein $v_i$ is the average speed and $N_i$ is the sample size for edge i, erf is the error function, $m_i$ is the "true" speed and C is the congestion threshold speed. Error function erf may be calculated with numerical integral techniques. C may be selected based on the standardized grade level of the edge (or road). For example, for road of grade level 1, according to the China National Standard, C is chosen to be 20 km/h.

Figure 9A:
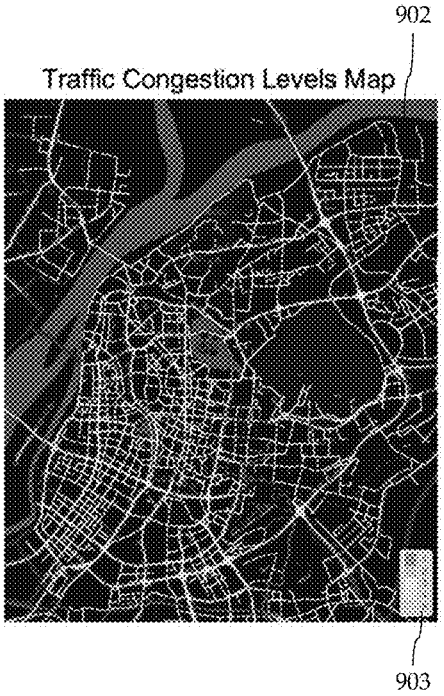
FIG. 9*a* shows a conventional traffic congestion level map.

Returning to FIG. 2, at 210, congestion monitor 124 presents a report of congestion probabilities. In some implementations, the report is displayed as a map of the region of interest indicating different levels of congestion according to the congestion probabilities. The map may be updated in substantially real-time by congestion monitor 124 in response to receiving and processing new vehicle data. FIG. 9*a* shows a conventional traffic congestion level map 902. Different traffic congestion levels may be indicated by a range of colors (e.g., from green to red, with red indicating severe congestion) or shades 903 (e.g., from light to dark shades, with dark shade indicating severe congestion). For example, traffic congestion levels may be classified into 5 levels according to severities: Grade 1 (red) to Grade 5 (green) corresponding to severe congestion and no congestion.

Figure 9B:
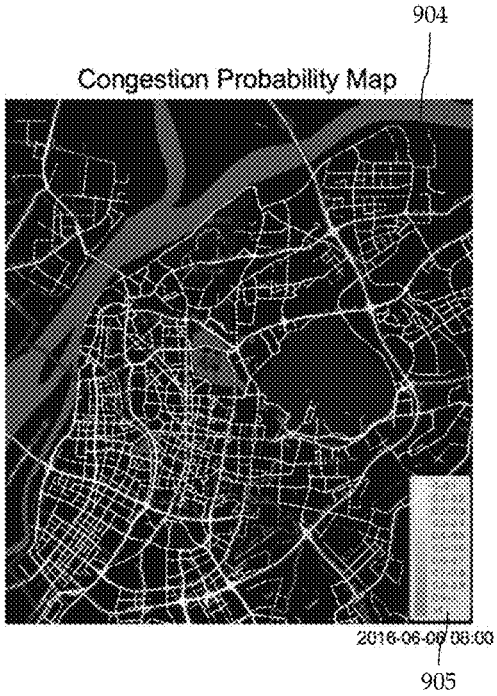
FIG. 9*b* shows a corresponding traffic congestion probability map that may be generated by congestion monitor.

FIG. 9*b* shows a corresponding traffic congestion probability map 904 that may be generated by congestion monitor 124. The traffic congestion probability map 904 represents the same geographical area during the same time slot as map 902. Traffic congestion probabilities for all roads over the urban network may be represented as numerical values 905 ranging from 0 to 1.

In some implementations, the traffic congestion probability map may be generated and displayed based on a user-specified or predetermined confidence level M for the most severely congested edges (e.g., congestion level 1). When no confidence level is specified, all severely congested edges are marked in the traffic congestion probability map, but the confidence levels of the edges may be a mixture of different values (from 0% to 100%); this may be distracting to traffic managers because some of these "severely congested" edges are only marked "severe" due to random fluctuations. When a predetermined confidence level M is specified (e.g., 95%), edges with confidence levels greater than and/or equal to M are marked as congested in the map. The marked edges in the map are quite likely to be congested, and traffic managers should be more focused in these regions.

FIGS. 10*a-c* show various exemplary traffic congestion probability maps 1002*a-c* that may be generated by congestion monitor 124. More particularly, FIG. 10*a* shows an exemplary map that displays severely congested roads 1004*a* (according to the traffic condition labelling shown in FIG. 9*a*) overlaid together without specifying the level of confidence, while FIGS. 10*b* and 10*c* show exemplary maps that display severely congested roads 1004*b* and 1004*c* with confidence levels M at 80% and 95% respectively.

Returning to FIG. 2, at 212, congestion monitor 124 determines if it should continue to process vehicle data acquired in the next time slot (t+1). If so, the method 200 continues to 202 to receive such vehicle data and repeat steps 204 through 210. If not, the method 200 ends.

Although the one or more above-described implementations have been described in language specific to structural features and/or methodological steps, it is to be understood that other implementations may be practiced without the specific features or steps described. Rather, the specific features and steps are disclosed as preferred forms of one or more implementations.

The invention claimed is:

1. A computer system for monitoring traffic congestion, comprising:

a non-transitory memory device for storing computer-readable program code; and a processor in communication with the non-transitory memory device, the processor being operative with the computer-readable program code to perform operations including:

receiving, by a congestion monitor of the computer system, vehicle data within a time slot from vehicle data sources located in a region of interest, each vehicle data source being located in a vehicle in the region of interest;

determining, by the congestion monitor, a sample size and an average speed for an edge of the region of interest based on the vehicle data, wherein the sample size corresponds to a number of vehicles located in the edge of the region of interest within the time slot and the edge of the region of interest is a predefined segment of a road network of the region of interest and wherein an inverse of a variance of the average speed is linearly related to the sample size when the sample size is less than a predetermined value, determining, by the congestion monitor, a congestion probability based on the sample size and the average speed and by:

determining the congestion probability comprises determining the variance of the average speed, determining a slope of a graph of the inverse of the variance against the sample size, and modeling a distribution of true speed using a normal probability model, wherein a mean of the normal probability model is the average speed and a variance of the normal probability model is based on the slope, and presenting a report in a graphical user interface based on the congestion probability of the edge of the region of interest.

2. The computer system of claim 1 wherein the vehicle data comprises sequential data records the vehicle data sources, wherein at least one of the sequential data records comprises a device identifier, localization data, speed, time, or a combination thereof.

3. The computer system of claim 1 wherein the vehicle data sources comprise onboard mobile devices capable of continuously streaming the vehicle data.

4. The computer system of claim 1 wherein the report comprises a map of the region of interest indicating different levels of congestion based on the corresponding congestion probabilities of a plurality of edges of the region of interest.

5. The system of claim 1 wherein the determining the slope of the graph further comprises determining the slope based on historical vehicle data.

6. The system of claim 1 wherein the determining the congestion probability comprises determining a cumulative distribution of the normal probability model.

7. The system of claim 6 wherein the determining the cumulative distribution Pr comprises determining $$Pr(mi \leq C) = \frac{1}{2}\left[1 + \mathrm{erf}\left(\sqrt{\frac{Ni}{2}}\,\frac{C - vi}{12.8}\right)\right]$$

wherein $v_i$ is the average speed, $N_i$ is the sample size, erf is an error function, $m_i$ is a true speed and C is a congestion threshold speed.

8. The system of claim 7 wherein the congestion threshold speed is selected based on a standardized grade level of the edge.

9. The system of claim 1 wherein presenting the report based on the congestion probability comprises displaying a map of the region of interest indicating different levels of congestion based on the corresponding congestion probabilities of a plurality of edges of the region of interest and further comprising updating the map in real-time in response to receiving new vehicle data.

10. A method of monitoring traffic congestion, the method being implemented by at least one computing device and comprising:

receiving, by a congestion monitor of the at least one computing device, vehicle data within a time slot from vehicle data sources located in a region of interest; each vehicle data source being located in a vehicle in the region of interest;

determining, by the congestion monitor, a sample size and an average speed for an edge of the region of interest based on the vehicle data, wherein the sample size corresponds to a number of vehicles located in the edge of the region of interest within the time slot and the edge of the region of interest is a predefined segment of a road network of the region of interest and wherein an inverse of a variance of the average speed is linearly related to the sample size when the sample size is less than a predetermined value;

determining, by the congestion monitor, a congestion probability based on the sample size and the average speed and by:

determining the congestion probability comprises determining the variance of the average speed;

determining a slope of a graph of the inverse of the variance against the sample size; and modeling a distribution of true speed using a normal probability model, wherein a mean of the normal probability model is the average speed and a variance of the normal probability model is based on the slope; and presenting a report in a graphical user interface based on the congestion probability of the edge of the region of interest.

11. The method of claim 10 wherein the determining the slope of the graph comprises determining the slope based on historical vehicle data.

12. The method of claim 10 wherein the determining the congestion probability comprises determining a cumulative distribution of the normal probability model.

13. The method of claim 12 wherein the determining the cumulative distribution Pr comprises determining $$Pr(m_i \le C) = \frac{1}{2}\left[1 + \mathrm{erf}\left(\sqrt{\frac{N_i}{2}}\,\frac{C - v_i}{12.8}\right)\right]$$

wherein $v_i$ is the average speed, $N_i$ is the sample size, erf is an error function, $m_i$ is a true speed and C is a congestion threshold speed.

14. The method of claim 13 wherein the congestion threshold speed is selected based on a standardized grade level of the edge.

15. The method of claim 10 wherein the presenting the report based on the congestion probability comprises displaying a map of the region of interest indicating different levels of congestion based on the corresponding congestion probabilities of a plurality of edges of the region of interest.

16. The method of claim 15 further comprises updating the map in real-time in response to receiving new vehicle data.

17. The method of claim 15 wherein the map indicates the different levels of congestion with different colors.

18. The method of claim 15 wherein the displaying the map comprises marking all severely congested edges in the map.

19. The method of claim 15 wherein the displaying the map comprises marking edges with confidence levels greater than a predetermined confidence level.

20. One or more non-transitory computer-readable media having stored thereon program code, the program code executable by a computer to perform steps comprising:

receiving, by a congestion monitor of the computer, vehicle data within a time slot from vehicle data sources located in a region of interest; each vehicle data source being located in a vehicle in the region of interest;

determining, by the congestion monitor, a sample size and an average speed for an edge of the region of interest based on the vehicle data; wherein the sample size corresponds to a number of vehicles located in the edge of the region of interest within the time slot and the edge of the region of interest is a predefined segment of a road network of the region of interest and wherein an inverse of a variance of the average speed is linearly related to the sample size when the sample size is less than a predetermined value;

determining, by the congestion monitor, a congestion probability based on the sample size and the average speed and by:

determining the congestion probability comprises determining the variance of the average speed;

determining a slope of a graph of the inverse of the variance against the sample size: and modeling a distribution of true speed using a normal probability model, wherein a mean of the normal probability model is the average speed and a variance of the normal probability model is based on the slope; and presenting a report in a graphical user interface based on the congestion probability of the edge of the region of interest.

* * * * *